US007481255B1

(12) United States Patent
Rees

(10) Patent No.: US 7,481,255 B1
(45) Date of Patent: Jan. 27, 2009

(54) SYSTEM FOR SECURING ITEMS IN A PURSE

(76) Inventor: Christina Rees, 58-130 Mamao St., Haleiwa, HI (US) 96712

( * ) Notice: Subject to any disclaimer, the term of this patent is extended or adjusted under 35 U.S.C. 154(b) by 662 days.

(21) Appl. No.: 11/097,699

(22) Filed: Apr. 1, 2005

(51) Int. Cl.
*A45C 13/40* (2006.01)

(52) U.S. Cl. ..... 150/119; 24/303; 150/106

(58) Field of Classification Search ..... 150/106, 150/108, 119; 24/303
See application file for complete search history.

(56) References Cited

U.S. PATENT DOCUMENTS

| | | | | | |
|---|---|---|---|---|---|
| 3,034,320 | A * | 5/1962 | Feibelman | ..... | 63/14.1 |
| 3,111,736 | A | 11/1963 | Budreck | | |
| 3,415,300 | A | 12/1968 | Worcester | | |
| 3,682,216 | A | 8/1972 | Nelson | | |
| 3,978,902 | A | 9/1976 | Adkison | | |
| 4,004,325 | A | 1/1977 | Hubachek | | |
| 4,940,250 | A * | 7/1990 | Corrado | ..... | 206/37.1 |
| 5,388,439 | A | 2/1995 | Miller | | |
| 5,974,634 | A * | 11/1999 | Eisenpresser | ..... | 24/303 |
| 6,170,088 | B1 * | 1/2001 | Tate | ..... | 2/209.13 |
| 7,120,972 | B2 * | 10/2006 | O'Banion | ..... | 24/303 |
| 2004/0163297 | A1 * | 8/2004 | Lin | ..... | 40/640 |

* cited by examiner

*Primary Examiner*—Tri M Mai
(74) *Attorney, Agent, or Firm*—Jeffrey A. Proehl; Woods, Fuller, Shultz & Smith PC

(57) ABSTRACT

A system for securing a metallic item in a purse is disclosed and comprises a first magnet for positioning exterior on the exterior face of the purse wall, and a second magnet for positioning in the purse interior on the interior face of the wall, the second magnet being magnetically attracted to the first magnet. An ornament may be mounted on the first magnet to obscure at least a portion of the first magnet. A method includes positioning the first magnet adjacent to the exterior face of the wall, positioning the second magnet adjacent to the interior face at a location that is substantially opposite of the first magnet such that magnetic attraction pulls the first and second magnets toward each other on the opposite wall faces, and moving the metallic item into the interior and bringing the item into contact with the second magnet such that the item is magnetically attracted thereto.

8 Claims, 3 Drawing Sheets

SYSTEM FOR SECURING ITEMS IN A PURSE

RELATED DOCUMENTS

This invention was the subject of a disclosure document filed in the U.S. Patent and Trademark Office on Mar. 19, 2004 and was assigned disclosure document no. 549,334.

BACKGROUND OF THE INVENTION

1. Field of the Invention

The present invention relates to article securing devices and more particularly pertains to a new system for securing items in a purse that is easily mounted on and removed from the purse for permitting easy retrieval of the items.

2. Description of the Prior Art

The use of article securing devices is known in the prior art. In the context of purses or other handbags, devices have been proposed that require the mounting of one component on the purse or handbag and another component on the item to be secured, such as a key or key ring. This type of approach increases the bulkiness of the item to be secured, and can also make the item relatively difficult to remove, depending upon the technique used for securing the components together. Further, and probably most disadvantageously, some devices require a permanent or semi-permanent mounting of one of the components to the purse is required, which may damage or require alteration of the purse, but also makes it difficult if not virtually impossible to transfer the device between purses In these respects, the system for securing items in a purse according to the present invention substantially departs from the conventional concepts and designs of the prior art, and in so doing provides an apparatus primarily developed for the purpose of permitting easy retrieval of the items.

SUMMARY OF THE INVENTION

In view of the foregoing disadvantages inherent in the known types of article securing devices now present in the prior art, the present invention provides a new system for securing items in a purse wherein the same can be easily mounted on and removed from the purse for permitting easy retrieval of the items.

In general, the present invention takes advantage of the metallic nature of items, such as keys and key rings, to secure the items on a purse or handbag or garment.

To attain this, the present invention in one aspect generally comprises a system for securing at least one metallic item in a purse at least partially defined by a wall having an interior face corresponding to an interior of the purse and an exterior face corresponding to an exterior of the purse. The system comprises a first magnet for positioning exterior of the purse adjacent to the exterior face of the wall defining the purse and a second magnet for positioning in the interior of the purse adjacent to the interior face of the wall defining the purse. The second magnet is magnetically attracted to the first magnet.

In one preferred embodiment of the system, an ornament is mounted on the first magnet to obscure at least a portion of the first magnet from view when the first magnet is positioned adjacent to the exterior of the purse.

In another aspect of the present invention, a method of securing at least one metallic item in a purse is disclosed. The method comprises providing an apparatus for securing at least one metallic item to the purse, in which the apparatus includes a first magnet for positioning exterior of the purse adjacent to the exterior face of the wall defining the purse and a second magnet for positioning in the interior of the purse adjacent to the interior face of the wall defining the purse. The method further comprises positioning the first magnet adjacent to the exterior face of the wall of the purse, and positioning the second magnet adjacent to the interior face of the wall of the purse at a location that is substantially opposite of a location of the first magnet adjacent to the exterior face such that magnetic attraction pulls the first magnet and the second magnet toward each other on the opposite faces of the wall of the purse. The method also includes moving the at least one metallic item into the interior of the purse and bringing the at least one metallic item into contact with the second magnet such that the at least one metallic item is magnetically attracted to the second magnet.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ease with which the system is attached to the purse without damaging the purse or requiring alterations to the purse. The system is also easily removed from the purse, but remains securely attached to the purse unless the user applies significant force to the magnets to release the magnets from the purse, and thus the chance of unintended release from the purse is greatly reduced. Further, nothing needs to be added to the item (such as a key or key ring) that would increase the bulk of the key ring.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
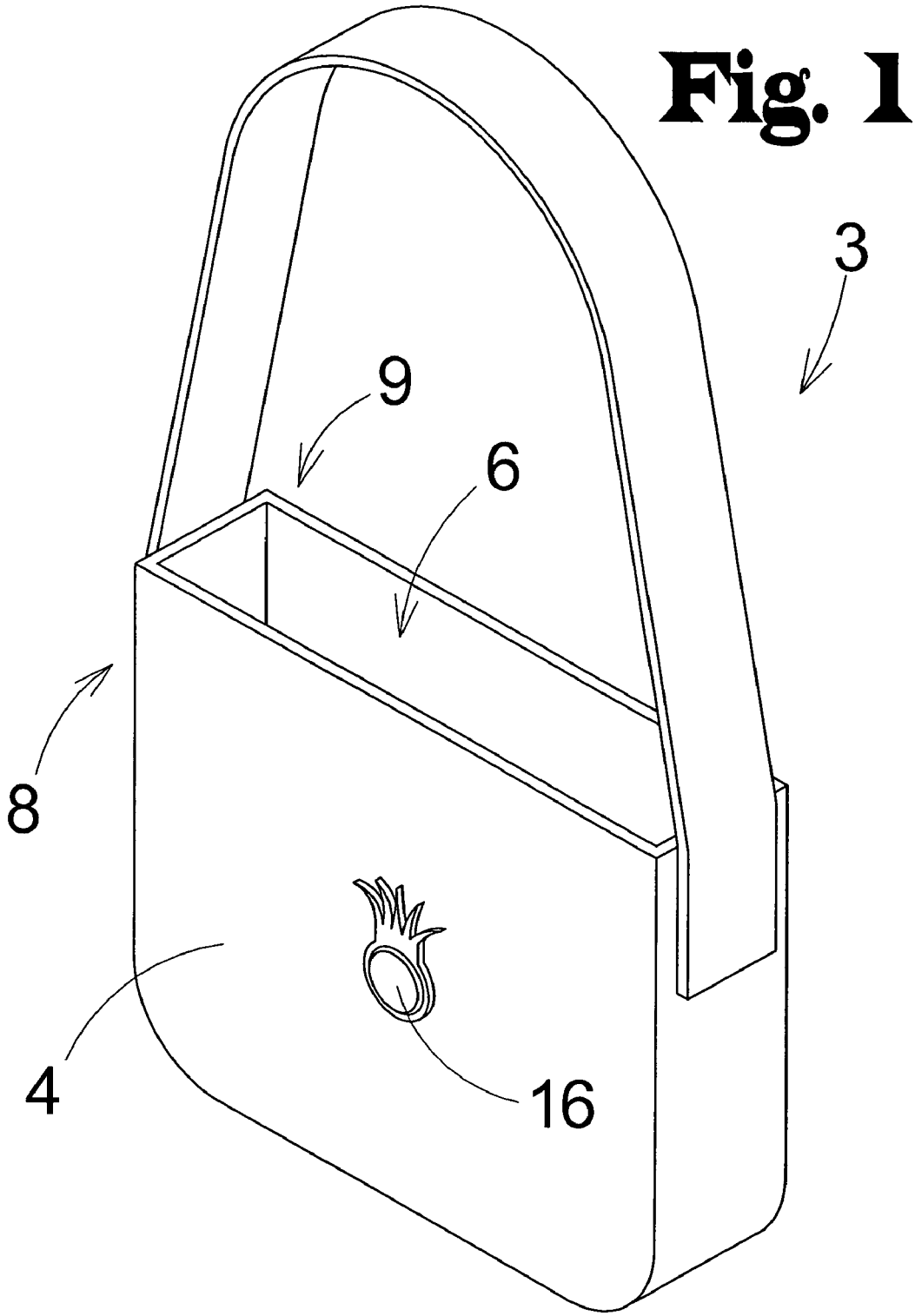
FIG. 1 is a schematic perspective view of a purse having the new system for securing items according to the present invention positioned thereon.
Figure 2:
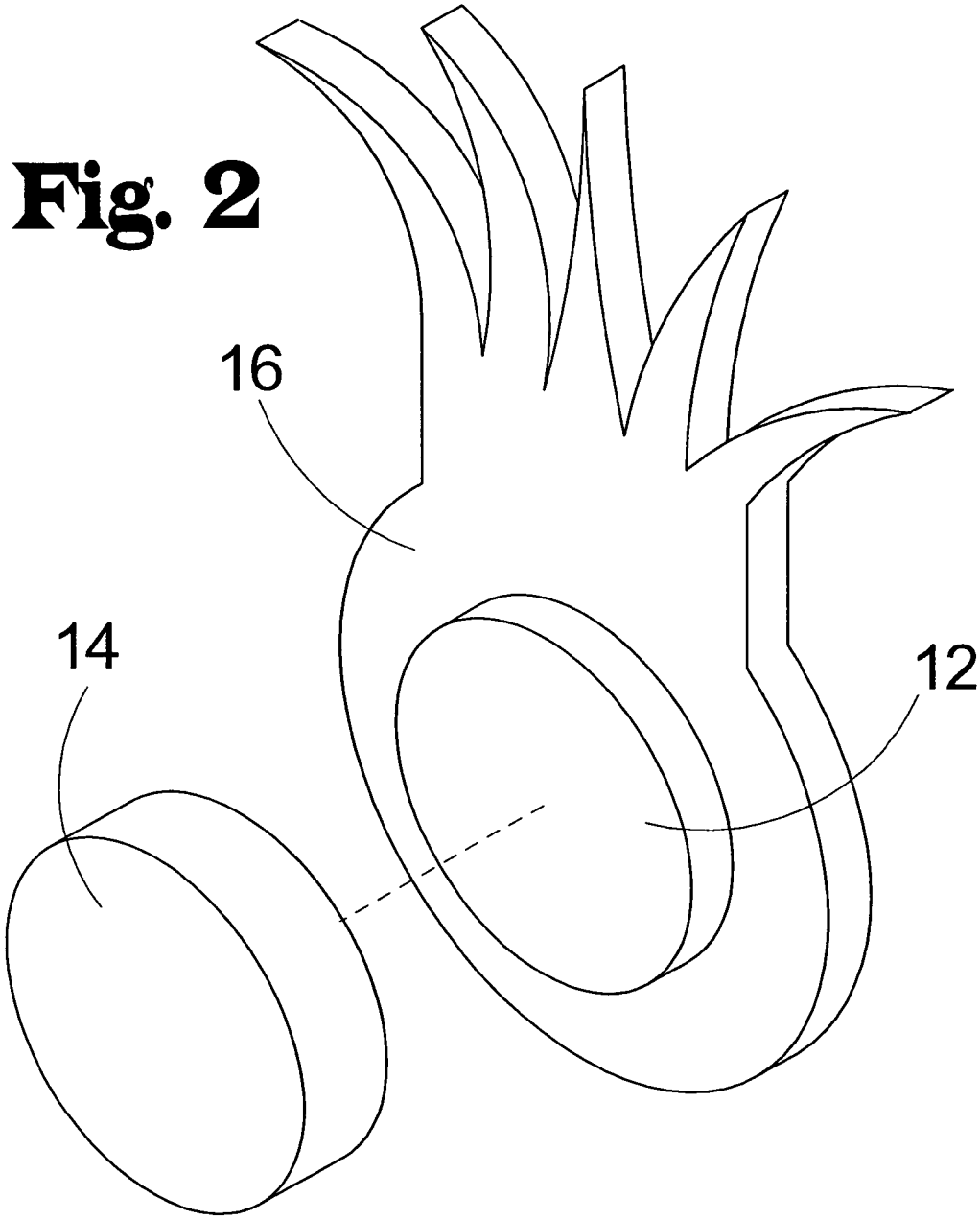
FIG. 2 is a schematic perspective view of elements of the present invention.
Figure 3:
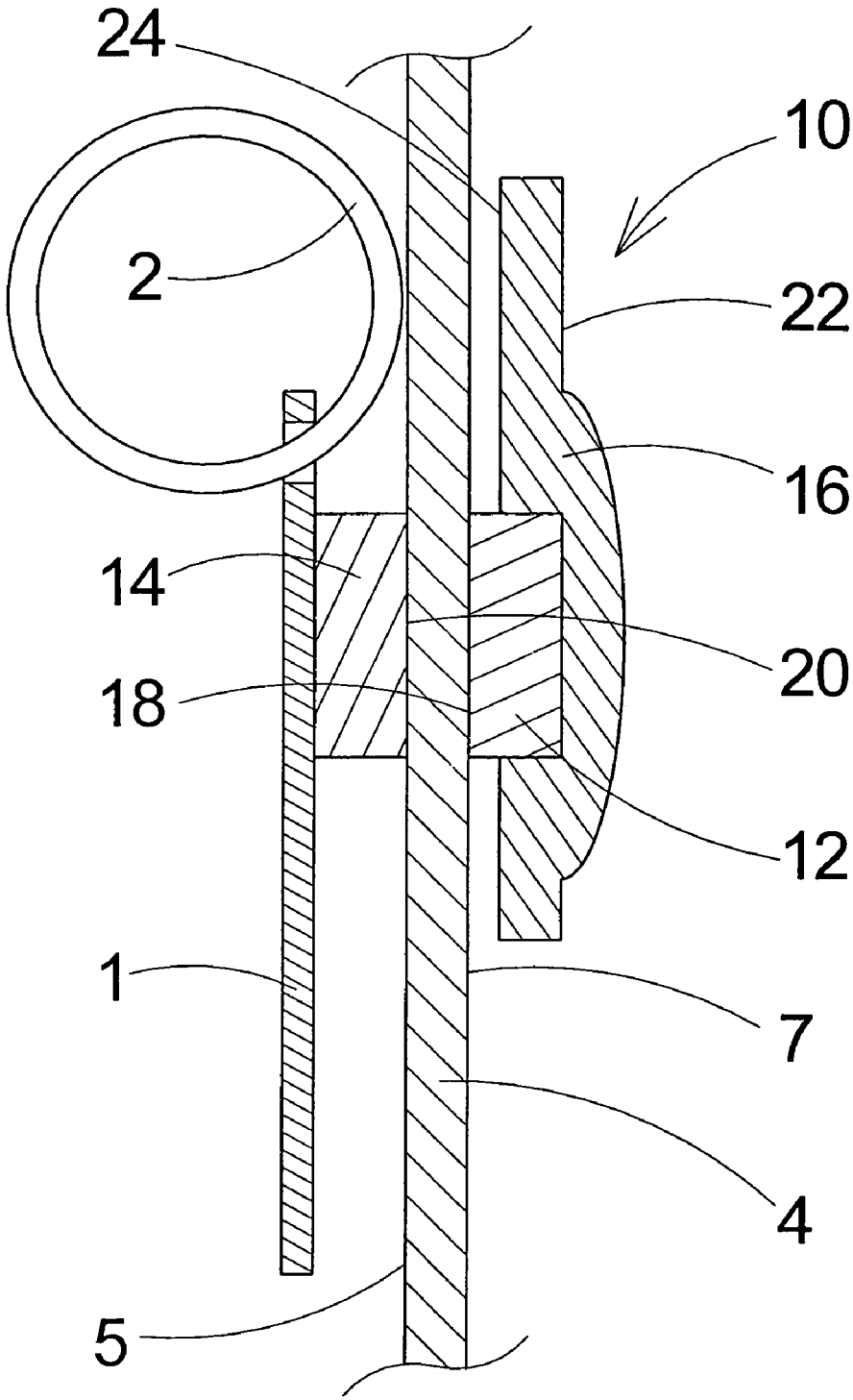
FIG. 3 is a schematic side sectional view of the present invention mounted on the wall of a purse.

With reference now to the drawings, and in particular to FIGS. 1 through 3 thereof, a new magnets for securing items in a purse embodying the principles and concepts of the present invention and generally designated by the reference numeral 10 will be described.

One aspect of the invention is directed to a system 10 for securing at least one metallic item, such as a key 1 or key ring 2, on, and preferably in, a purse 3 (see FIG. 1). The purse 3 may be at least partially defined by a wall 4 that has an interior face 5 corresponding to an interior 6 of the purse 3 and an exterior face 7 corresponding to an exterior 8 of the purse 3 (see FIG. 3). The system 10 may generally include a first magnet 12 for positioning exterior of the purse 3 adjacent to the exterior face 5 of the wall 4, a second magnet 14 for positioning in the interior 6 of the purse 3 adjacent to the interior face 5 of the wall 4 (see FIGS. 2 and 3). The system 10 may also include an ornament 16 mounted on the first magnet 12 to obscure at least a portion of the first magnet from view when the first magnet is positioned adjacent to the exterior of the purse 3.

The first magnet 12 may have a first side 18 which is substantially planar for abutting against the exterior face 7 of the wall 4 of the purse 3. It will be appreciated that the extent of the substantially planar first side 18 of the first magnet 12 should be maximized to facilitate the magnetic engagement between the first magnet and the second magnet 16. In the illustrative embodiment of the invention, the first magnet 12 has a substantially disc-shaped configuration, which helps to increase the relative size of the first side 18 of the first magnet.

The second magnet 14 is magnetically attracted to the first magnet 12. The second magnet 14 may have a first side 20 which is substantially planar for abutting against the interior face 7 of the wall 4 of the purse 3. The second magnet 14 may also be substantially disc-shaped to also enhance the size of the first side 20 of the second magnet 14. The magnetic material employed for the first and second magnets should have suitably strong magnetic fields, and one suitable material is Neodymium-Iron-Boron (NdFeB), although other suitably strong materials could also be used. For example, the magnetic material could be Alnico and Ceramic/Ferrite types, although these types are typically less powerful and the effectiveness of the invention might be reduced. While it is possible that one of the first and second magnets could simply comprise a more weakly magnetized material such as iron or steel, such materials generally result in magnetic attraction that is not suitably and reliably strong enough to assure that the metallic item will remain secured to the second magnet until pulled from the second magnet by the user. In one embodiment of the invention, each of the first 12 and second 14 magnets has a diameter of approximately 20 mm (approximately 0.8 inches), which provides sufficient magnetic strength while not being overly bulky.

Optionally, an ornament 16 may be provided on the first magnet 12 to substantially hide the first magnet 12 from view when in use on the purse, or make the first magnet more attractive to view. In one embodiment of the invention, the ornament 16 covers at least two sides of the first magnet while leaving exposed the first side 18 of the first magnet. The ornament 16 may have a front surface 22 and a rear surface 24. The rear surface 24 may be substantially planar to facilitate positioning of the rear surface 24 adjacent to the exterior face 7 of the wall 4 of the purse 3. The ornament 16 may be mounted on the first magnet 12 such that the first side 18 of the first magnet 12 is substantially flush with the rear surface 24 of the ornament 16. The front surface 22 may have a contoured, decorative design formed thereon. For example, in the illustrative embodiment, the front surface resembles a pineapple, but it will be evident that other decorative shapes may be employed, including a palm tree, dolphin, and heart. Optionally, the magnet or magnets may be coated whether or not an ornament is mounted on the magnet.

In implementation on the purse 3, the first magnet 12 is positioned exterior 8, or outside, of the purse adjacent to the exterior face 7 of the wall 4 that defines at least a portion of the purse, with the first side 18 of the first magnet being abutted against the exterior face 7 of the wall of the purse. The second magnet 14 is positioned in the interior 6 of the purse 3 adjacent to the interior face 5 of the wall 4, with the second magnet 14 being magnetically attracted to the first magnet 12 through the wall 4. The first side 20 of the second magnet 14 is abutted against the interior face 5 of the wall 4. Preferably, the first 12 and second 14 magnets are positioned on the wall 4 between about halfway from the bottommost extent of the interior 6 and the upper opening 9 of the purse, and the upper opening, although other positions on the purse could certainly be selected. At least one metallic item, such as a key or a key ring holding a key, is positioned in the interior 6 of the purse 3 and is removably attached to the second magnet 14 by magnetic attraction of the metallic item to the second magnet 14.

It should be recognized that although the invention has been described in the context of use on a purse, the concept and structure of the invention is suitable for use on other articles, including articles of clothing, such as interior/exterior of a pocket on a garment.

The invention further includes a method of securing at least one key in a purse. The method may include providing the apparatus for securing keys to the purse including the first magnet and the second magnet. The first magnet is positioned adjacent to the exterior face of the wall of the purse and the second magnet is positioned adjacent to the interior face of the wall of the purse at a location that is substantially opposite of a location of the first magnet adjacent to the exterior face such that magnetic attraction pulls the first magnet and the second magnet toward each other on the opposite faces of the wall of the purse. It will be recognized that the order of positioning the first and second magnets is not critical to the practice of the method and may be accomplished with either magnet being positioned first, or may be positioned simultaneously.

The key or keys and optionally a key ring may be moved into the interior of the purse, and the key or keys or key ring may be brought into contact with the second magnet positioned in the interior of the purse such that the same is magnetically attracted to the second magnet. The magnetic attraction between the metal of the key or key ring and the second magnet functions to hold the key or key ring securely in place in the interior of the purse, while allowing the key or key ring to be readily removed from the second magnet by the application of a firm pull on the key or key ring. The key or key ring may be removed from the second magnet without removing the second magnet from the first magnet, so the first and second magnets remain in place on the wall of the purse.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination:

a purse having an interior and an exterior, the purse being at least partially defined by a wall having an interior face corresponding to an interior of the purse and an exterior face corresponding to an exterior of the purse;

a key securing apparatus for securing keys to the purse, comprising:

a first magnet positioned exterior of the purse adjacent to the exterior face of the wall defining the purse; and a second magnet positioned in the interior of the purse adjacent to the interior face of the wall defining the purse, the second magnet being magnetically attracted to the first magnet through the wall of the purse; and at least one metallic item positioned in the interior of the purse, the at least one metallic item being removably attached to the second magnet by magnetic attraction to the second magnet;

wherein the key securing apparatus includes an ornament mounted on the first magnet to obscure at least a portion of the first magnet from view as the first magnet is positioned adjacent to the exterior of the purse;

wherein the ornament has a rear surface with a substantially planar portion and a cavity-defining portion defining a cavity extending into the ornament, the first magnet being partially received in the cavity such that a portion of the first magnet protrudes beyond a plane of the substantially planar portion of the rear surface of the ornament such that a first side of the first magnet is exposed and capable of contacting the exterior surface of the purse.

2. The combination of claim 1 wherein the first side of the first magnet is substantially planar for abutting against the exterior face of the wall of the purse.

3. The combination of claim 2 wherein the second magnet has a first side which is substantially planar for abutting against the interior face of the wall of the purse.

4. The combination of claim 1 wherein the at least one metallic item comprises a key.

5. The combination of claim 1 wherein the first magnet has a thickness, and wherein approximately one-third of the thickness of the first magnet protrudes beyond the plane of the substantially planar portion of the rear surface of the ornament.

6. The combination of claim 1 wherein the first magnet has a thickness, and wherein approximately one-third of the thickness of the first magnet protrudes beyond the plane of the substantially planar portion of the rear surface of the ornament;

wherein the first side of the first magnet is substantially planar for abutting against the exterior face of the wall of the purse;

wherein the second magnet has a first side which is substantially planar for abutting against the interior face of the wall of the purse; and wherein the ornament has a rear surface that is substantially planar for facilitating positioning of the rear surface adjacent to the exterior face of the wall of the purse.

7. The combination of claim 1 wherein the ornament has a front surface with a contoured design formed thereon, and the contoured design resembles one object selected from a group of objects consisting of a pineapple, a palm tree, a dolphin, and a heart.

8. A method of securing at least one metallic item in a purse at least partially defined by a wall having an interior face corresponding to an interior of the purse and an exterior face corresponding to an exterior of the purse, the method comprising:

providing an apparatus for securing at least one metallic item to the purse, the apparatus including:

a first magnet;

a second magnet being magnetically attractable to the first magnet through the wall of the purse;

an ornament mounted on the first magnet to obscure at least a portion of the first magnet from view as the first magnet is positioned adjacent to the exterior of the purse, the ornament having a rear surface with a substantially planar portion and a cavity-defining portion defining a cavity extending into the ornament, the first magnet being partially received in the cavity such that a portion of the first magnet protrudes beyond a plane of the substantially planar portion of the rear surface of the ornament such that a first side of the first magnet is exposed and capable of contacting the exterior surface of the purse;

positioning the first magnet adjacent to an exterior face of the wall of the purse;

positioning the second magnet adjacent to an interior face of the wall of the purse at a location that is substantially opposite of a location of the first magnet adjacent to the exterior face such that magnetic attraction pulls the first magnet and the second magnet toward each other on the opposite faces of the wall of the purse; and moving the at least one metallic item into the interior of the purse and bringing the at least one metallic item into contact with the second magnet such that the at least one metallic item is magnetically attracted to the second magnet.

* * * * *